US005255491A

United States Patent [19]

Marovskis et al.

[11] Patent Number: 5,255,491

[45] Date of Patent: Oct. 26, 1993

[54] METHOD AND APPARATUS FOR APPLYING BANDS TO CRATES

[75] Inventors: Harijs B. Marovskis, Plymouth; Thomas H. Peterman, Farwell; Todd Wheeler, Alexandria, all of Minn.

[73] Assignee: Tetra Alfa Holdings S.A., Pully, Switzerland

[21] Appl. No.: 830,303

[22] Filed: Jan. 31, 1992

[51] Int. Cl.[5] ..... B65B 13/04; B65B 13/06; B65B 27/00; B65B 35/52

[52] U.S. Cl. ..... 53/399; 53/447; 53/541; 53/589

[58] Field of Search ..... 53/399, 449, 447, 540, 53/589, 541; 100/1, 26

[56] References Cited

U.S. PATENT DOCUMENTS

| | | | |
|---|---|---|---|
| 3,279,355 | 10/1966 | Missioux | 100/26 |
| 3,329,083 | 7/1967 | Bellmann | 100/26 X |
| 3,427,959 | 2/1969 | Keil | 100/26 X |
| 3,489,076 | 1/1970 | Countryman | 53/589 X |
| 4,483,245 | 11/1984 | Fetters | 100/26 X |
| 4,484,518 | 11/1984 | Jaenson | 100/26 X |
| 4,622,893 | 11/1986 | Magoni et al. | 53/589 X |
| 4,867,053 | 9/1989 | Kawai et al. | 53/589 X |
| 4,912,908 | 4/1990 | Sakaki | 53/589 |
| 4,998,637 | 3/1991 | Marovskis . | |
| 5,020,304 | 6/1991 | Peterman et al. | 53/589 X |
| 5,076,457 | 12/1991 | Marovskis . | |

FOREIGN PATENT DOCUMENTS 11755 8/1976 Sweden .

*Primary Examiner*—Horace M. Culver

*Attorney, Agent, or Firm*—Burns, Doane, Swecker & Mathis

[57] ABSTRACT

Apparatus for filling crates with packages is disclosed. The crates have hinged sides. The apparatus unfolds the sides of a crate and places the packages in the crate between the upright sides. The filled crates are transported on a conveyor to a bander. In the bander, a flexible band is applied around the outside of the upright sides. The banded crates are stacked by the apparatus with the bottom of the upper crate resting on the top edge of the upright sides of the lower crate. The banded and stacked crates may be transported horizontally while stacked.

11 Claims, 15 Drawing Sheets

Fig. 6
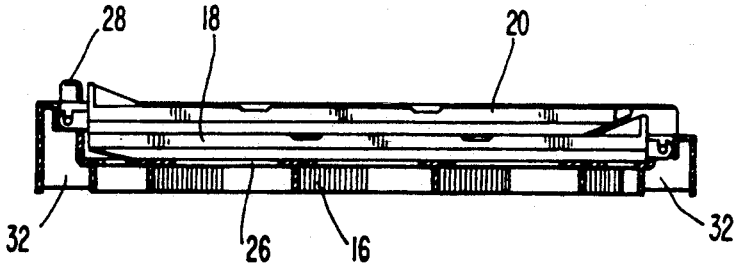
Fig. 7
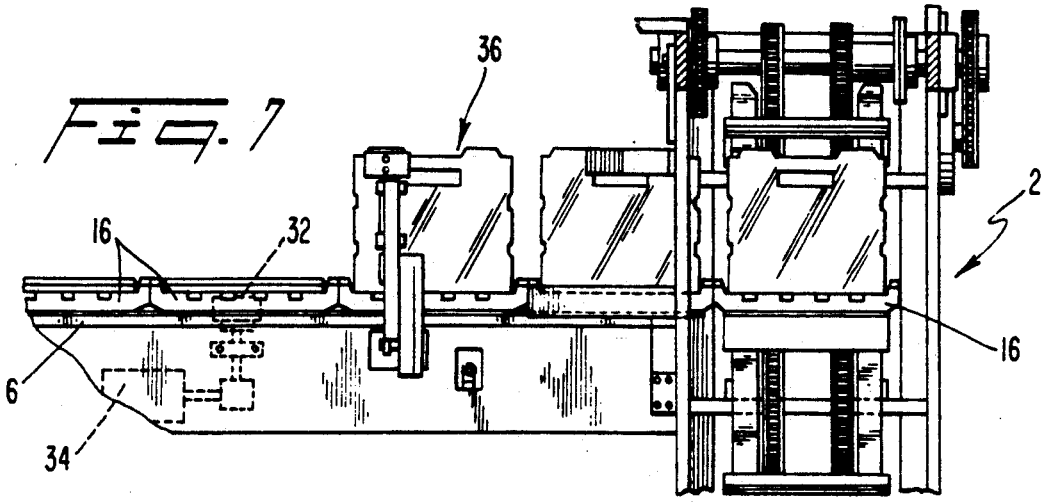
Fig. 8
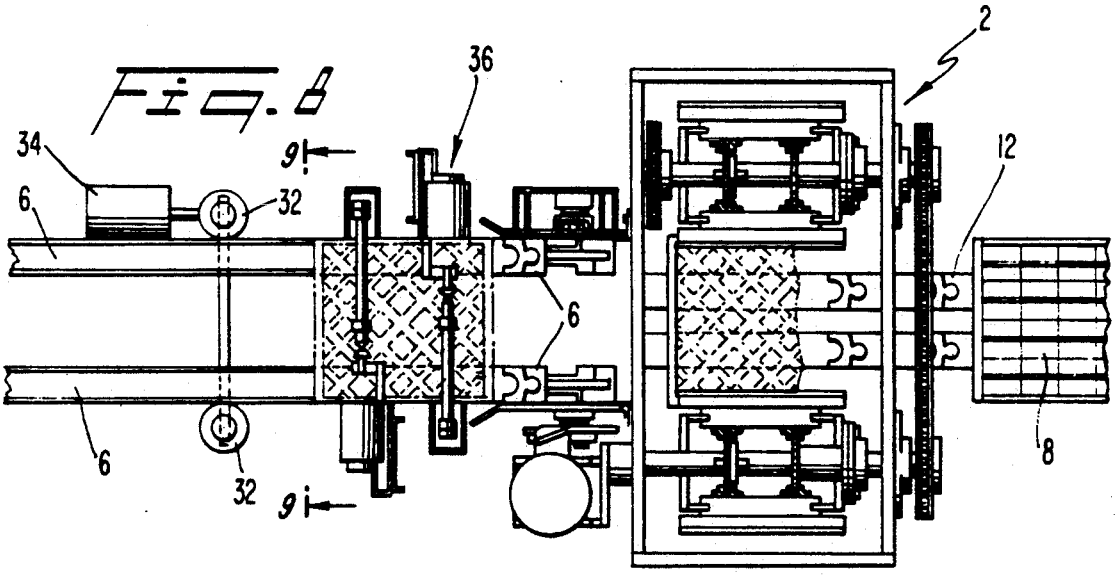
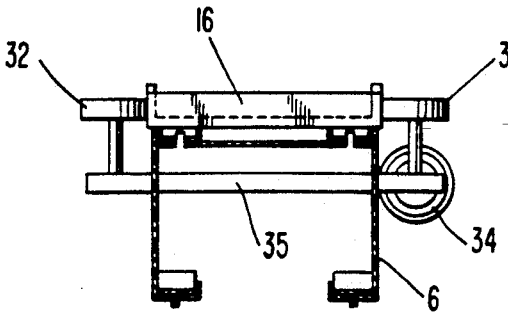
Fig. 9

Fig. 14
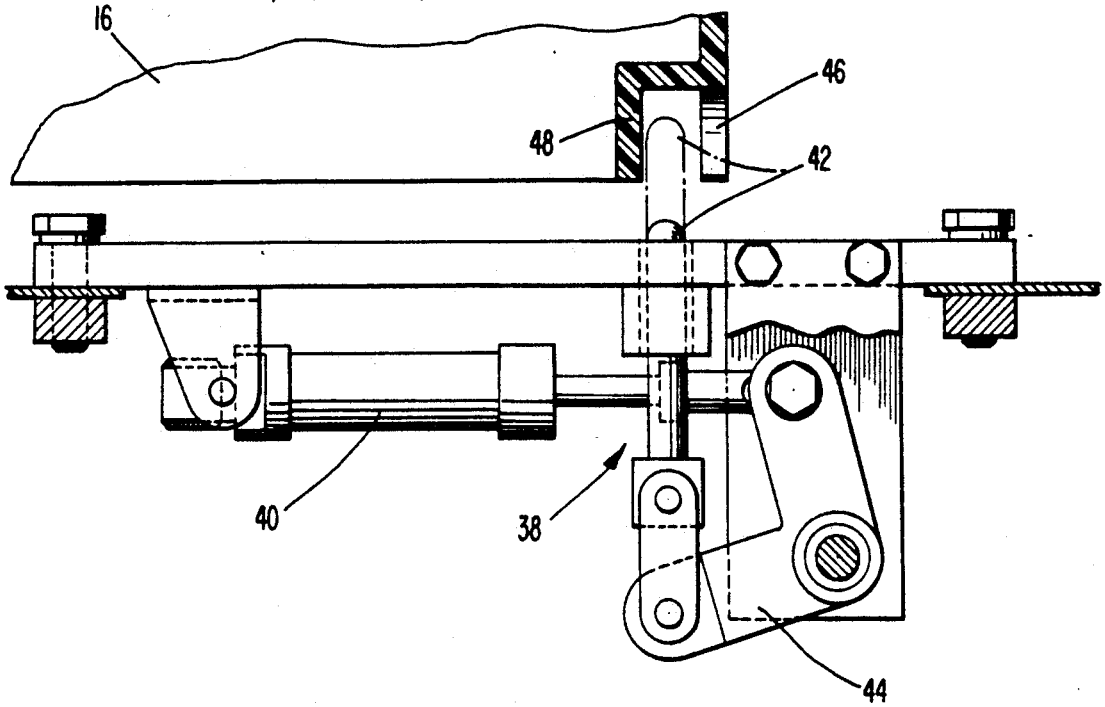
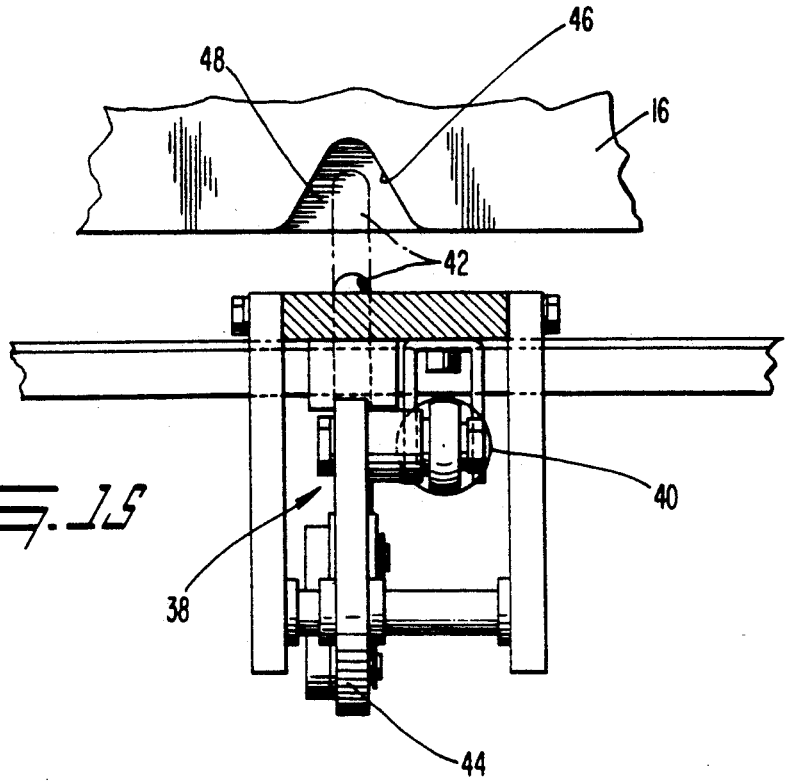
Fig. 15

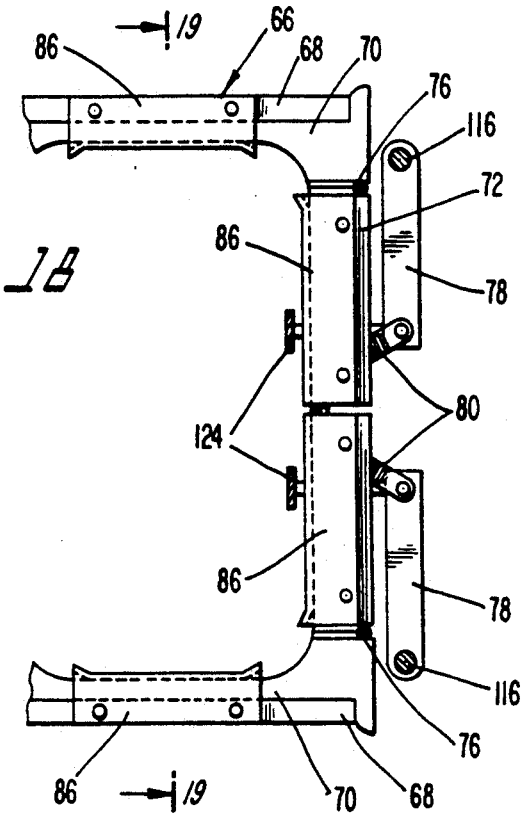
Fig. 18
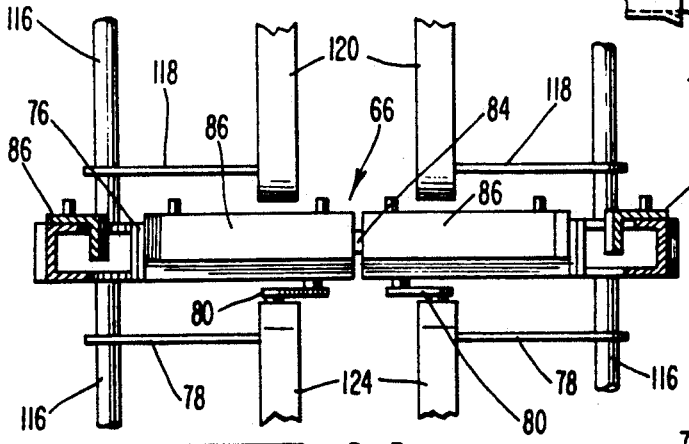
Fig. 19
Fig. 20
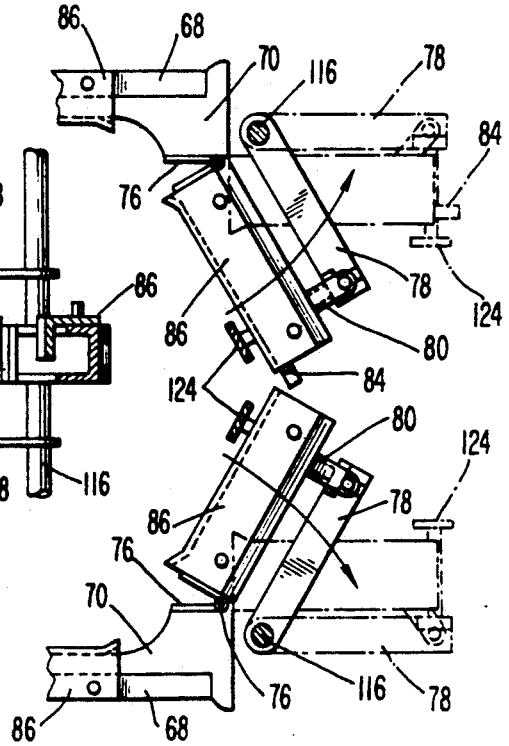

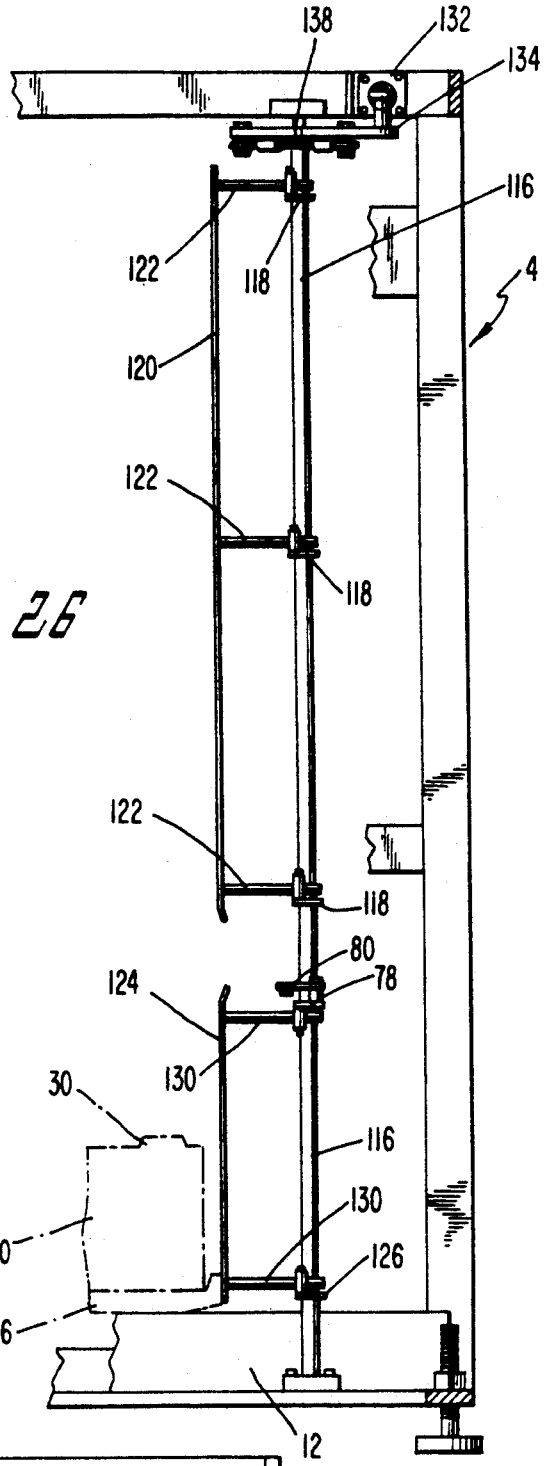
Fig. 26
Fig. 27
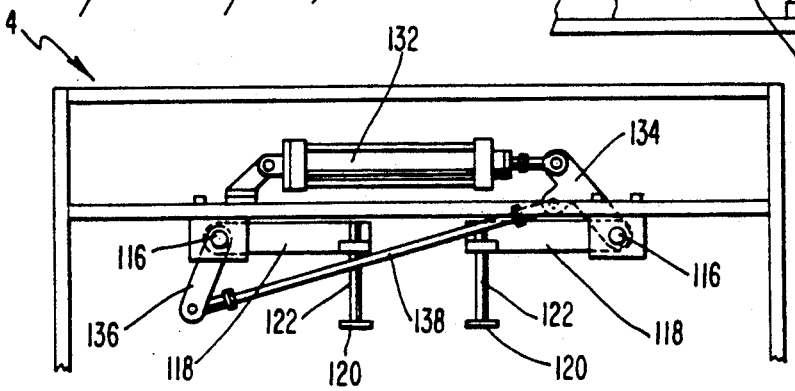

METHOD AND APPARATUS FOR APPLYING BANDS TO CRATES

FIELD OF THE INVENTION

This invention relates to methods and apparatus for filling crates with packages and, more particularly, to systems for utilizing returnable crates for delivering packages of products including cartons containing liquid.

BACKGROUND OF THE INVENTION

In the dairy industry, milk is sold in a variety of containers, including paper-based cartons of various sizes. In order to reduce the cost of handling the individual cartons, they are customarily packed in crates for shipment to stores. Typically, the cartons are removed by the store employees and placed on shelves so that customers can remove individual packages from the shelves. The empty crates are then returned to the dairy or to the packaging plant to be filled again with cartons.

The crates are relatively light in weight, but occupy a large volume. As a result, the empty crates that are stored at the packaging facility require a large amount of space. Often the crates are stacked out-of-doors where they are subject to being blown over by wind or are maintained in very tall stacks which are difficult to handle.

Although machines are available for packing cartons in the crates, these machines operate relatively slowly. Since the crates are in the form of an open box with four rigid side walls, it is necessary for the machines to lower the cartons through the top of the crate, which may cause excessive stress on the packaging material that can lead to leakage of the cartons.

It has been proposed previously to utilize crates that have folding sides. U.S. Pat. No. 4,998,637 is an example of a crate having four folding sides which are held in an upright position by a band which encircles the side. Although this type of crate has the advantage of reducing the volume of the empty crate, but the crate is filled with cartons utilizing the conventional packing method of filling the crate through the open top.

Some of the inefficiencies of prior crate systems have been overcome by the method and apparatus disclosed in U.S. Pat. No. 5,020,304. This patent discloses the use of a folding crate which has only two side walls. The other two side walls are open. When cartons are placed between the two upright side walls, a strap is applied around the circumference of the crate to hold the cartons in the crate. This form of crate is also disclosed in U.S. patent application Ser. No. 07/535,341 filed Jun. 11, 1990, entitled "Folding Crate for Holding Packages".

Although the method and apparatus disclosed in U.S. Pat. No. No. 5,020,304 provide an efficient system for handling the filled cartons, it is nevertheless advantageous to improve the efficiency, cost and rate of production of the method and apparatus for handling and filling the crates.

OBJECTS AND SUMMARY OF THE INVENTION

An object of this invention is to provide an efficient system for handling crates and filling crates with cartons or other packages.

It is a further object of this invention to provide a system for applying the band to the filled crate.

It is another object of this invention to provide an improved system for supplying filled cartons and crates and placing the cartons in the crates in an efficient manner.

Another object of this invention is to provide a system for arranging the filled crates in a stack for subsequent transport.

These objects are accomplished in accordance with this invention by a method or process in which a crate having hinged side walls is filled with cartons or other packages. The filled crate is placed at a first location from which it is lifted to a second location that is spaced above the first location. A banding unit has a track that surrounds the crate at the second location. The banding unit sends a band through the track around outside of the side walls of the crate and draws the band tight. The ends of the band are then joined together to hold the band in place. Another crate is placed at the first location and is lifted upwardly until the side walls engage the base of the first crate. Further upward movement displaces the first crate upwardly until the second crate is at the second location. The banding unit then applies a band around the crate. The stacking and banding process is repeated until the desired number of crates have been stacked. The stack of crates is then lowered until the lowest crate is at the first location where it is supported on a conveyor. The conveyor is operated to convey the stack of crates to a desired location for further transportation.

This invention also includes apparatus for carrying out the process as described above. Specifically, the invention includes a bander unit that is positioned at the second location for applying a band around the crate and secured it in a groove in the crate to hold the contents of the crate in place. The bander unit includes a track for guiding the band around the track. In order to permit the stack of crates to move horizontally from the first location, the track has two track segments which are mounted on hinges so that they are able to swing from a closed position where they are in alignment with each other to an open position where there is sufficient space between the segments to allow the stack of crates to move horizontally to a desired location that is spaced from the first location. The apparatus also includes a lifter mechanism for raising a crate from the first location to the second location. The lifter mechanism preferably has a tandem actuator to provide a vertical adjustment of the crate when two bands are to be applied to the crate.

The invention also includes a friction wheel arrangement for advancing empty crates toward the lowerator rapidly. A stop pin device is provided to control the entry of filled crates to the first location of the stacker unit. Further details of the invention are described in the following detailed description and illustrated in the accompanying drawings.

DESCRIPTION OF THE DRAWINGS

A preferred embodiment of this invention is illustrated in the accompanying drawings, in which:

FIG. 6 is an end elevational view of the crate of FIG. 2 showing the side walls in a folded position and showing the base of the crate partially in cross-sectional view;

FIG. 7 is a side elevational view of the empty crate feeding station of the apparatus of this invention;

FIG. 8 is a top plan view of the empty crate feeding station;

FIG. 9 is a cross-sectional view of the feeding station along the line 9—9 in FIG. 8;

FIG. 14 is a detail side elevational view of the stop pin in the bander and stacker station;

FIG. 15 is an end elevational view of the stop pin mechanism;

FIG. 18 is a detail top plan view of the track of the bander unit;

FIG. 19 is a cross-sectional view of the track along the line 19—19 in FIG. 18;

FIG. 20 is a top plan view of the track as in FIG. 18, but showing the track segments in a partially open position;

FIG. 26 is a side elevational view of the door mechanism; and

FIG. 27 is a top plan view of the door mechanism.

DETAILED DESCRIPTION

The crate packer, bander and stacker of this invention is an improvement of the method and apparatus disclosed is U.S. Pat. No. 5,020,304, which is assigned to Tetra Pak Holdings S.A. The disclosure of this patent is incorporated herein by reference. The crates which are intended to be used with the apparatus of this invention are disclosed in U.S. patent application Ser. No. 07/535,341 filed Jun. 11, 1990, entitled "Folding Crate for Holding Packages", the disclosure of which is incorporated herein by reference.

Figure 1:
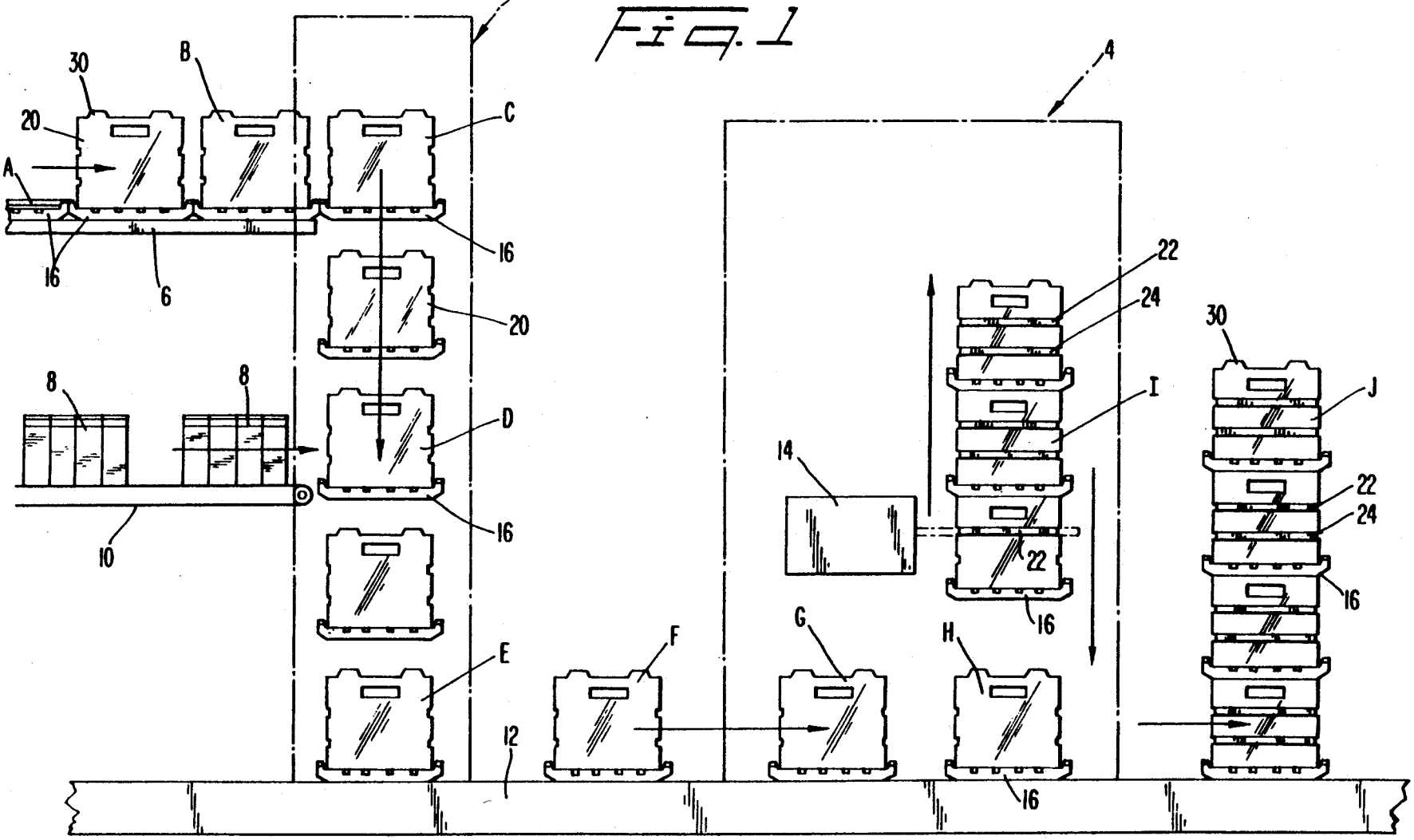
FIG. 1 is a side elevational view of the apparatus of this invention showing schematically the opening, filling, banding and stacking of the crates in accordance with this invention.

FIG. 1 is a side elevational, schematic view of the apparatus of this invention, which includes a lowerator unit 2 and a crate bander and stacker unit 4. An empty crate with the sides folded down against the bottom is conveyed toward the lowerator. The crate at this position is labeled A. The side walls of the crate are then raised at position B and the crate is advanced into the vertical conveyor of the lowerator unit 2 at the position C. The crate moves downwardly in the lowerator 2 until it reaches the carton-filling station where cartons or packages 8 are transferred from the conveyor 10 into the crate at the position D so that the crate is filled with the cartons 8 at this position. The lowerator then lowers the crates so that the lowermost crate at E rests on the main conveyor 12.

The conveyor 12 advances the filled crate from the position E to the position F and then into the bander and stacker unit 4 at the position G. At the appropriate time, the crate is advanced to the position H by the conveyor 12 and is lifted to the position I where a band is applied around the crate to hold the cartons in the crate and to unify the packing of the crate. As the crate moves from the position H to the position I, the raised side walls of the lower crate engage sockets in the bottom of the upper crate to lift the crate upwardly as the lower crate moves from position H to position I. This cycle is repeated until a stack of crates has been formed with the bands applied around the outside of the side walls. When a preselected height of crates has been achieved, the entire stack is lowered onto the conveyor 12 and advanced to the position J in FIG. 1. In this manner, the stack of crates at position J can be conveyed as a unit, thereby reducing handling time as compared to handling these crates individually.

Figure 2:
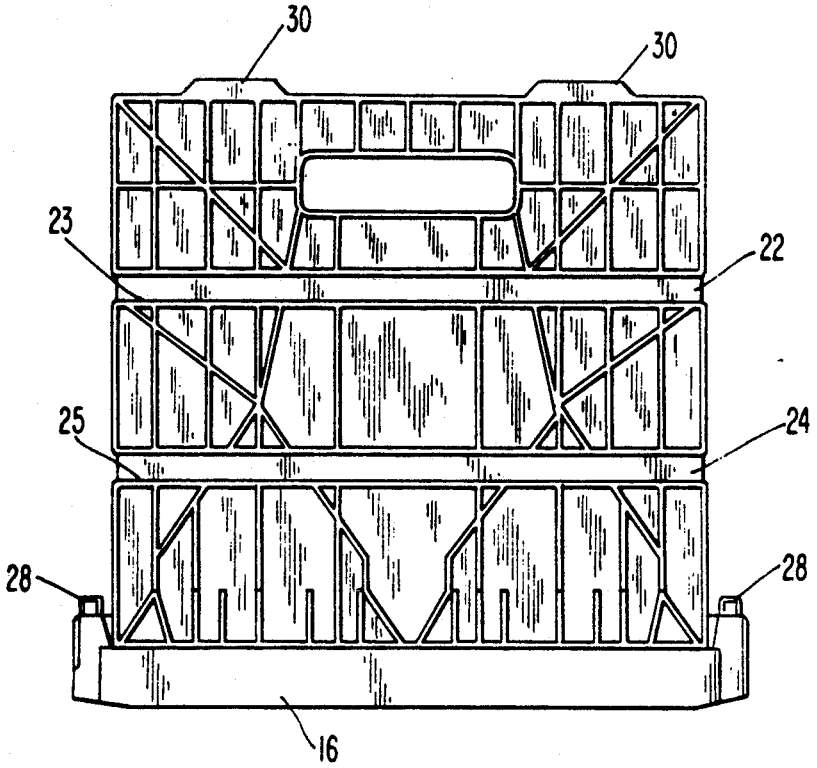
FIG. 2 is a side elevational view of a crate suitable for use with the apparatus of this invention.
Figure 5:
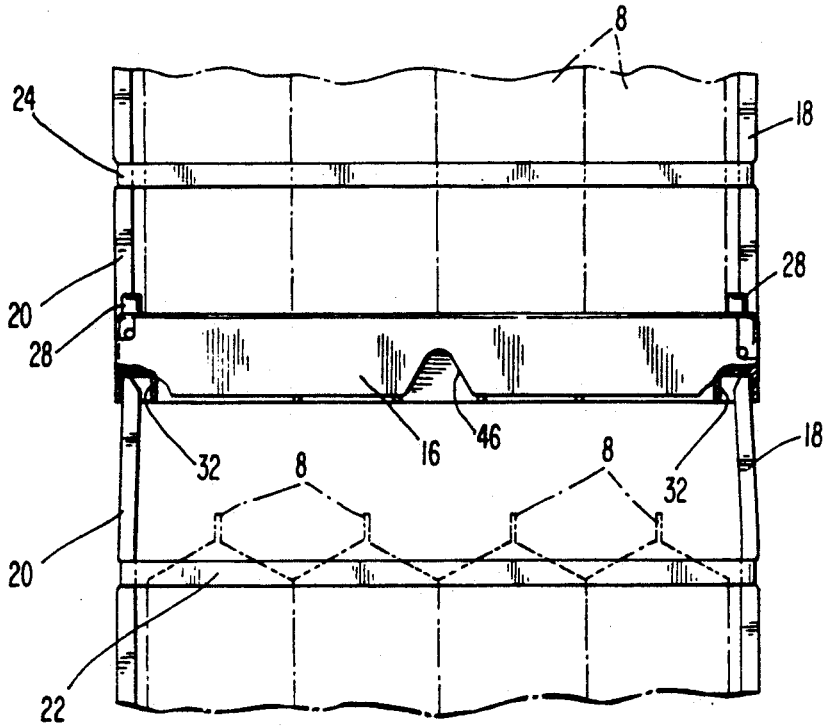
FIG. 5 is an end elevational view of one of the crates nested on the side walls of another crate.

Details of the structure of the crate are illustrated in FIGS. 2-6. The crate includes a base 16 and opposite folding side walls 18 and 20. A plurality of cartons 8 are shown in phantom lines in FIG. 3 in the crate. The cartons are retained in the crate by flexible bands 22 and 24 which are applied around the outside of the side walls 18 and 20 and across the open ends. The bands 22 and 24 are received in grooves 23 and 25, respectively, in the outer surface of the side walls. The base 16 includes a bottom support 26 (FIG. 4) which has openings to reduce its weight and provides a support surface for the bottom of the cartons 8. The base 16 also includes knobs 28 at three of its corners for stacking the folded crates on top of each other when they are empty. As shown in FIG. 2, each side wall at the top has projecting lugs 30 which are positioned to be received in corresponding sockets 32 in the bottom of the base 16 (FIG. 5). These sockets 32 provide a secure connection between the side walls 18 and 20 of the lower crate and the base of the upper crate when the crates are stacked as shown in FIG. 5. The crate is shown in FIG. 6 with the sides folded down to minimize the volume of the crate when it is empty. Further details of the structure of the crate are disclosed in patent application Ser. No. 07/535,341.

The crates are supplied to the lowerator unit 2 on a conveyor 6 in the folded condition as shown in FIG. 7. At the position corresponding to position A in FIG. 1, the crate at position A passes between a pair of friction wheels 32 which frictionally engage the sides of the base 16. The friction wheels 32 are driven in unison by a motor 34 which is timed to advance the crates in a precise cycle, so that the crates are located at the proper position for lifting the side walls at the lifting station 36 and then advancing the crates into the crate supports on the lowerator unit 2. The friction wheels 32 assure that the crates, which are supported on rails between the lowerator unit 2 and the friction wheels 32, are in abutting relation. The friction wheels 32 urge the crates into abutting relation and maintain the crates at the proper location for entering the lowerator unit.

Figure 10:
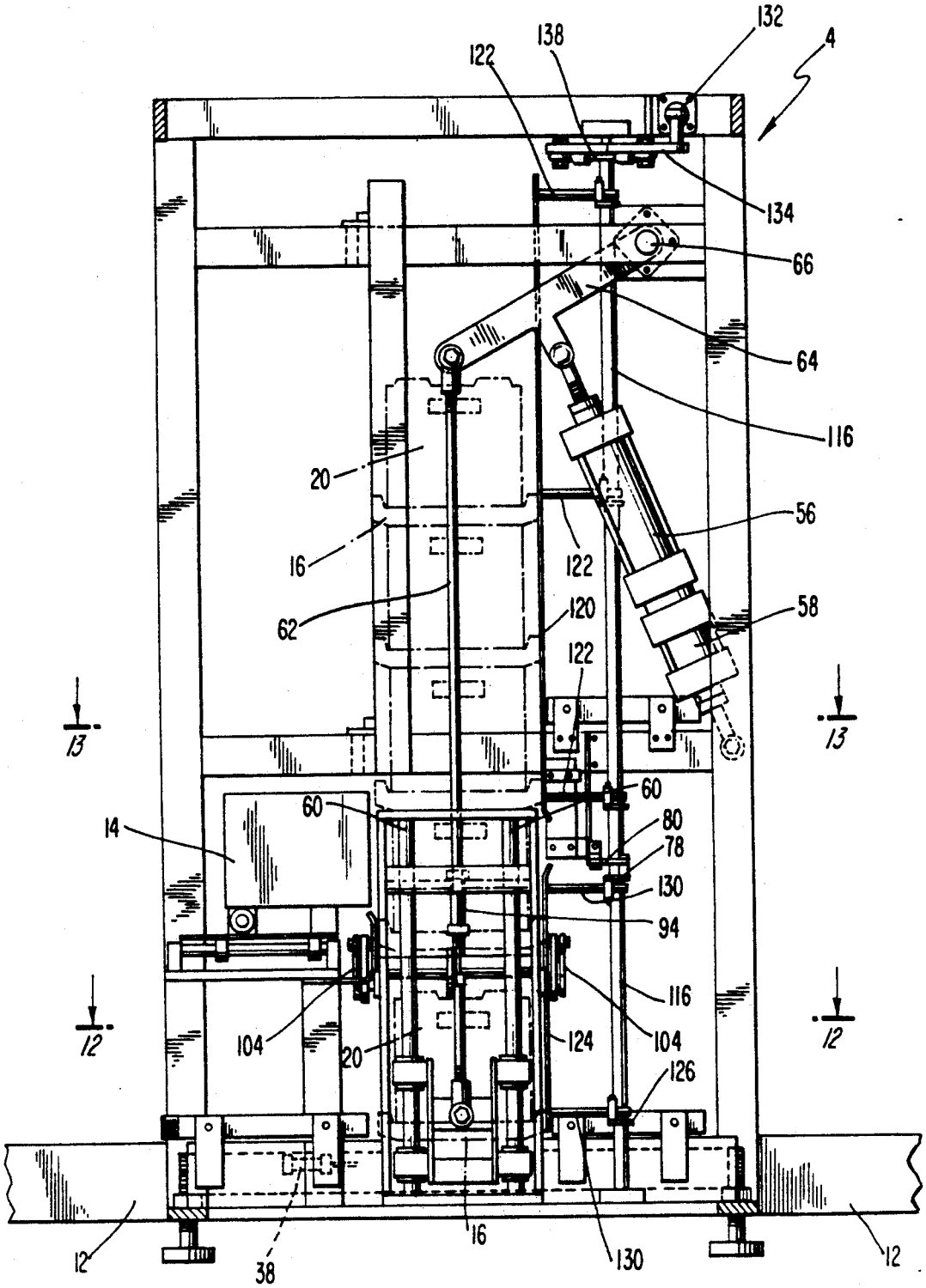
FIG. 10 is a side elevational view of the bander and stacker unit.
Figure 11:
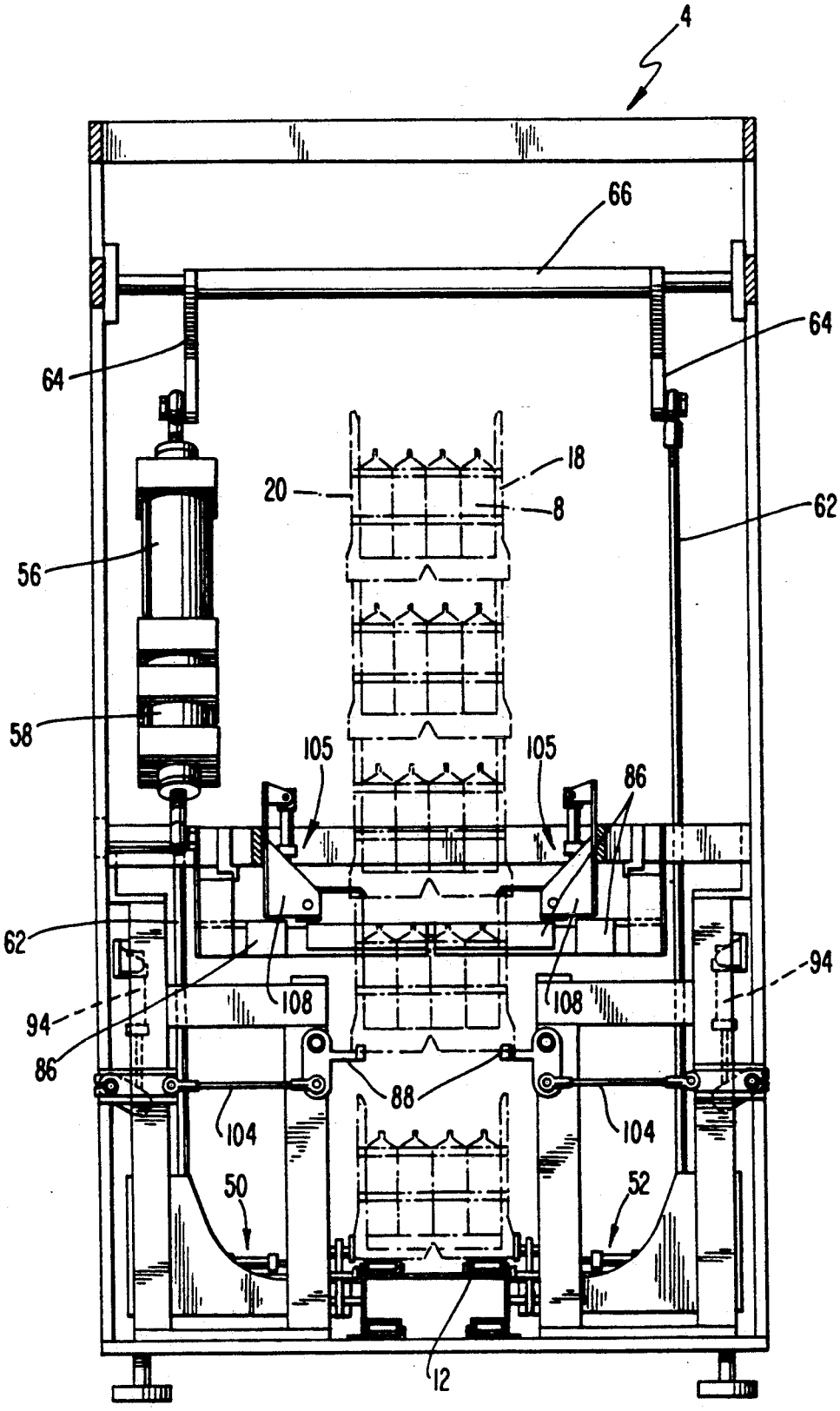
FIG. 11 is an end elevational view of the bander and stacker unit.
Figure 12:
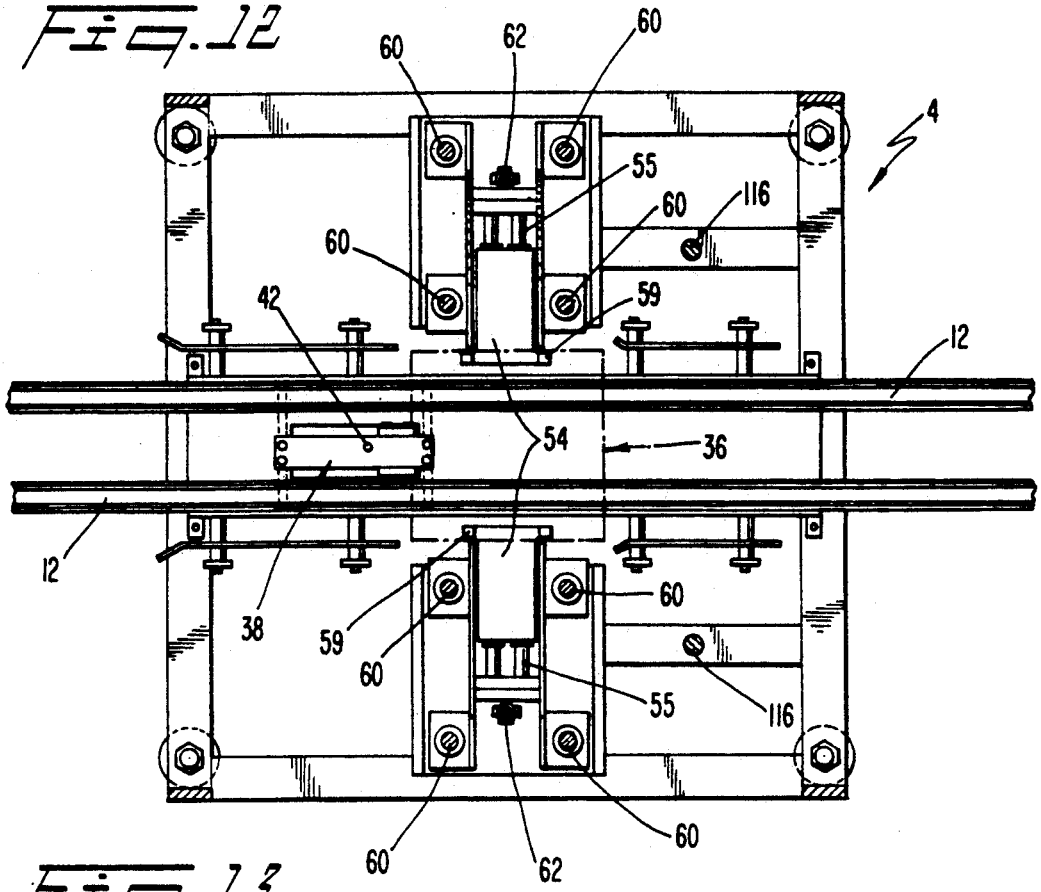
FIG. 12 is a cross-sectional view of the bander and stacker unit along the line 12—12 in FIG. 10.
Figure 13:
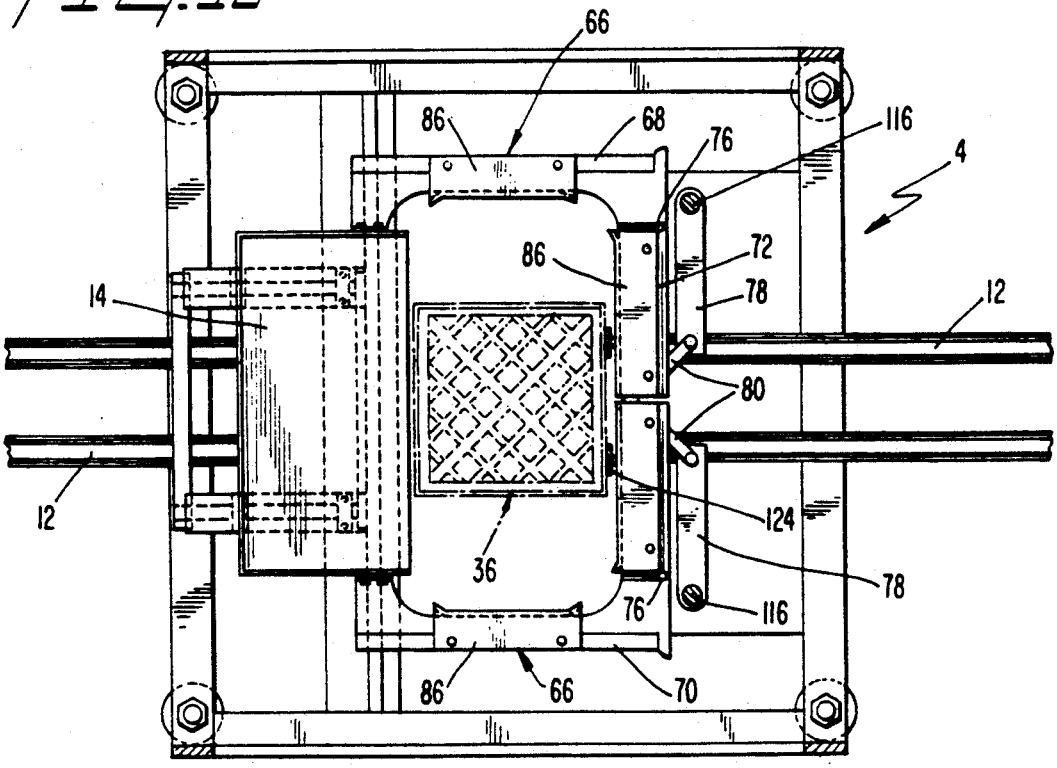
FIG. 13 is a cross-sectional view of the bander and stacker unit along the line 13—13 in FIG. 10.

The details of the structure of the lowerator unit and the loading of cartons in the crate are disclosed in U.S. Pat. No. 5,020,304. When a filled crate is discharged from the lowerator, it advances on the conveyor 12 to the bander and stacker unit 4 as shown in the schematic representation of FIG. 1. Referring to FIGS. 10–13, the bander and stacker unit 4 has a stop pin mechanism 38 located between the two tracks of the conveyor 12, as shown in FIGS. 10 and 12. The stop pin mechanism is shown in detail in FIGS. 14 and 15. The mechanism includes a pneumatic actuator 40 which is connected with a pivoted lever 41 that has a stop pin 42 formed at its movable end. A toggle linkage 44 connects the actuator with the lever 41. When the actuator 40 is operated to retract its piston rod toward the left as viewed in FIG. 14, the linkage 44 causes the lever 41 to swing downwardly, thereby retracting stop pin 42 sufficiently to allow the crate to pass. The base of the crate has an opening 46 to receive a hook for dragging the crate along a surface. The opening 46 also allows the stop pin to pass through the outside edge of the base 16 and to engage a rigid stop surface 48 formed in the interior of the base. By this arrangement, the stop pin 42 may be raised before the base of the crate reaches the location where it is to be stopped, thereby avoiding the necessity for precise control of the conveyor 12. Since the toggle linkage is perpendicular to the direction of movement of the incoming crate when the stop pin is in the raised position, the lever 41 absorbs the force of the incoming crate.

Figure 16:
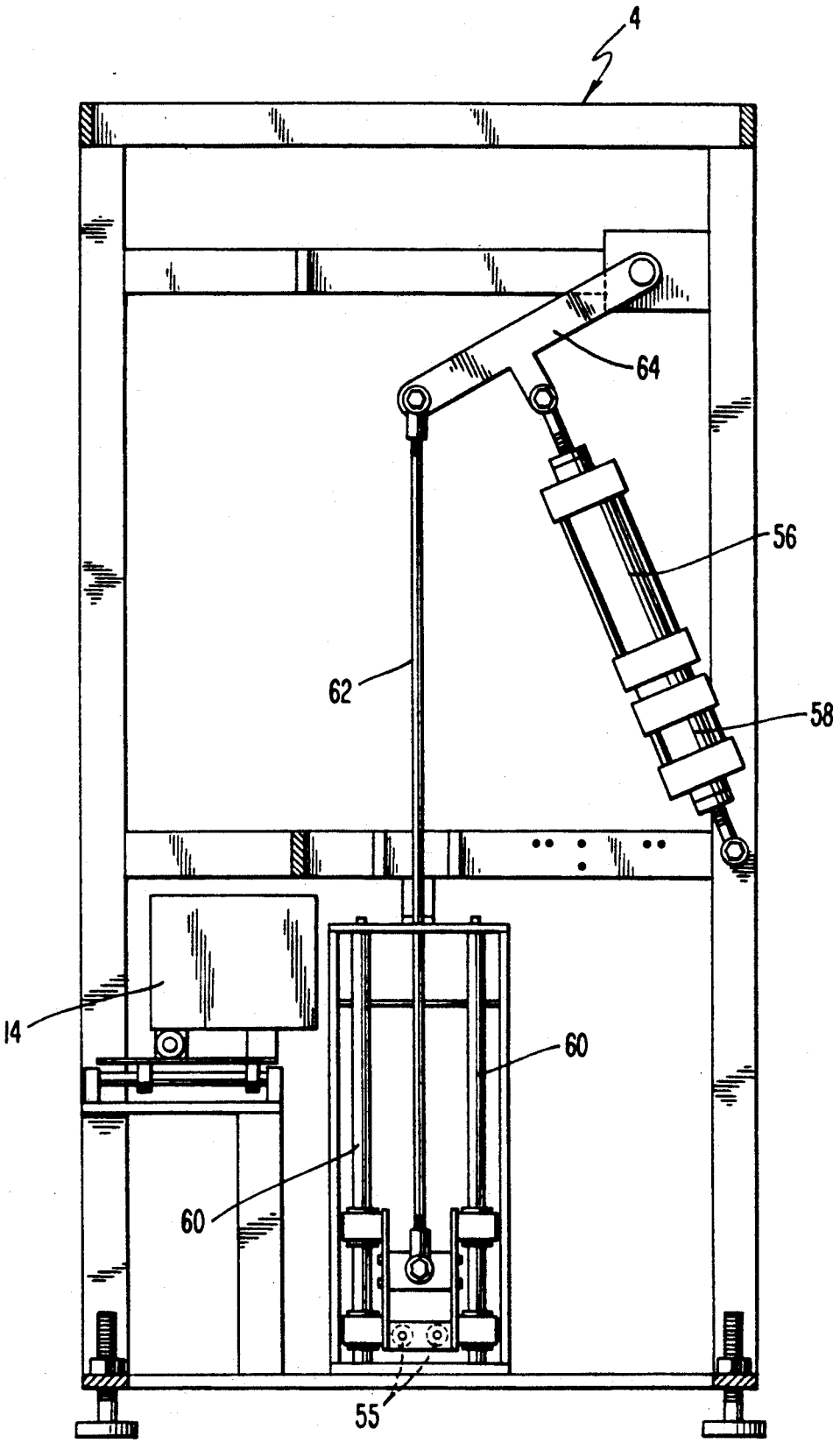
FIG. 16 is a side elevational view of the lifter mechanism of the bander and stacker unit.
Figure 17:
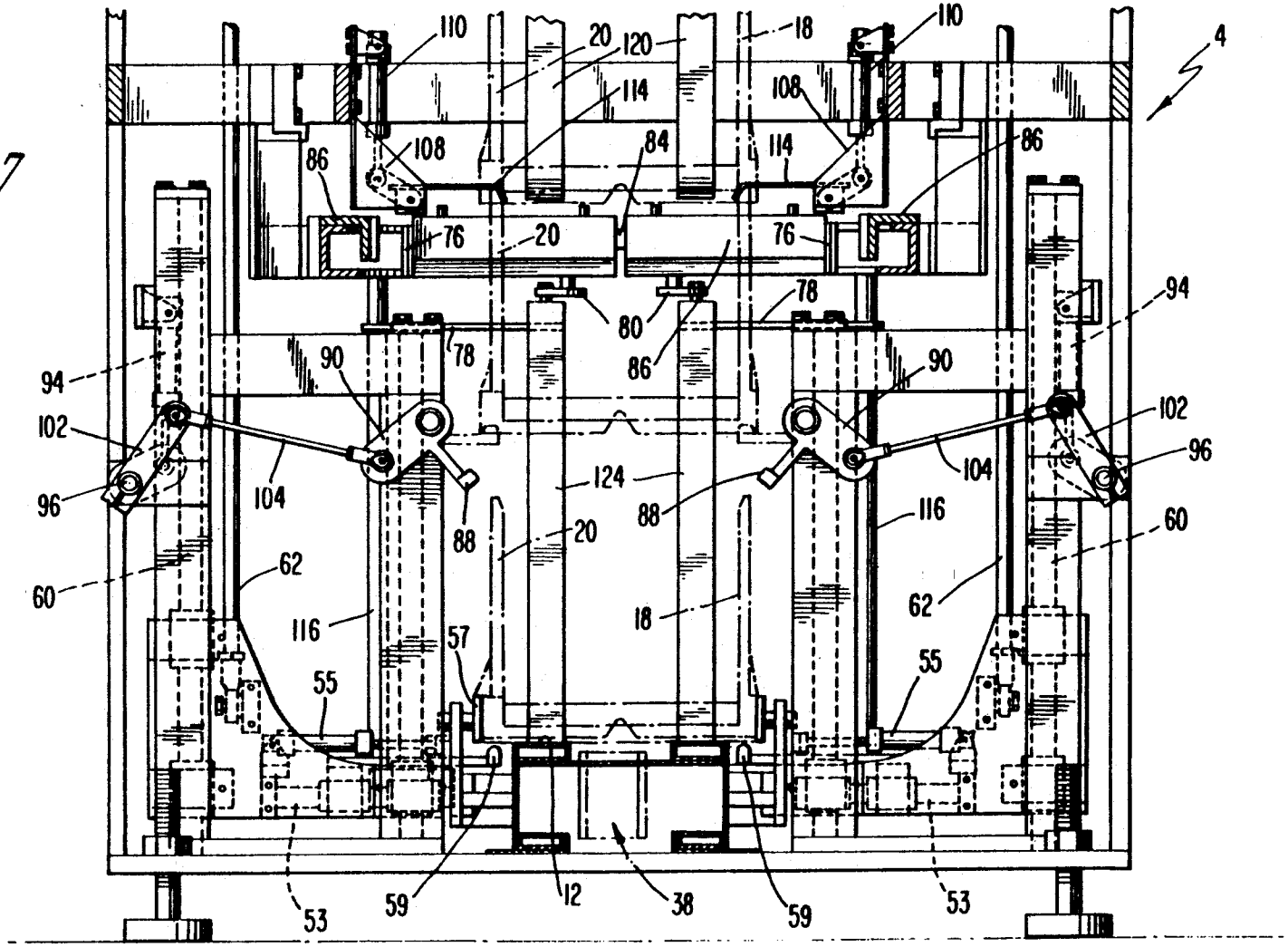
FIG. 17 is an end elevational view of the lifter mechanism.

When it is time for the filled crate to move into position where it is to be banded and stacked, the stop pin 42 is retracted, which releases the crate. The conveyor, which runs continuously, advances the crate to the desired position and the crate stops. On opposite sides of the conveyor, a pair of lifter mechanisms 50 and 52 (FIG. 11) are provided. The lifter mechanisms each have horizontal slides 54 which are mounted on horizontal bars 53 for reciprocating movement toward and away from each other in response to operation of slide actuators 55, as shown in FIG. 17. A pair of stationary rails 57 mounted on the conveyor engage the sides of the base of the crate. Each slide 54 has a pair of knobs 59 which engage under the base 16 for accurate positioning of the crate before it is lifted vertically off the conveyor 12. The slides 54 are mounted for vertical movement on posts 60. Vertical movement of the lifting mechanism is caused by tandem pneumatic actuators 56 and 58, as shown in FIGS. 11 and 16. The slides 54 are connected with the pneumatic actuators 56 and 58 through a connecting rod 62 and a lever 64. A cross-shaft 66 connects corresponding lever 65 and connecting rod 63 to the slide 54 so that the slides on opposite sides of the conveyor move vertically in unison upon operation of the pneumatic actuators 56 and 58.

Figure 3:
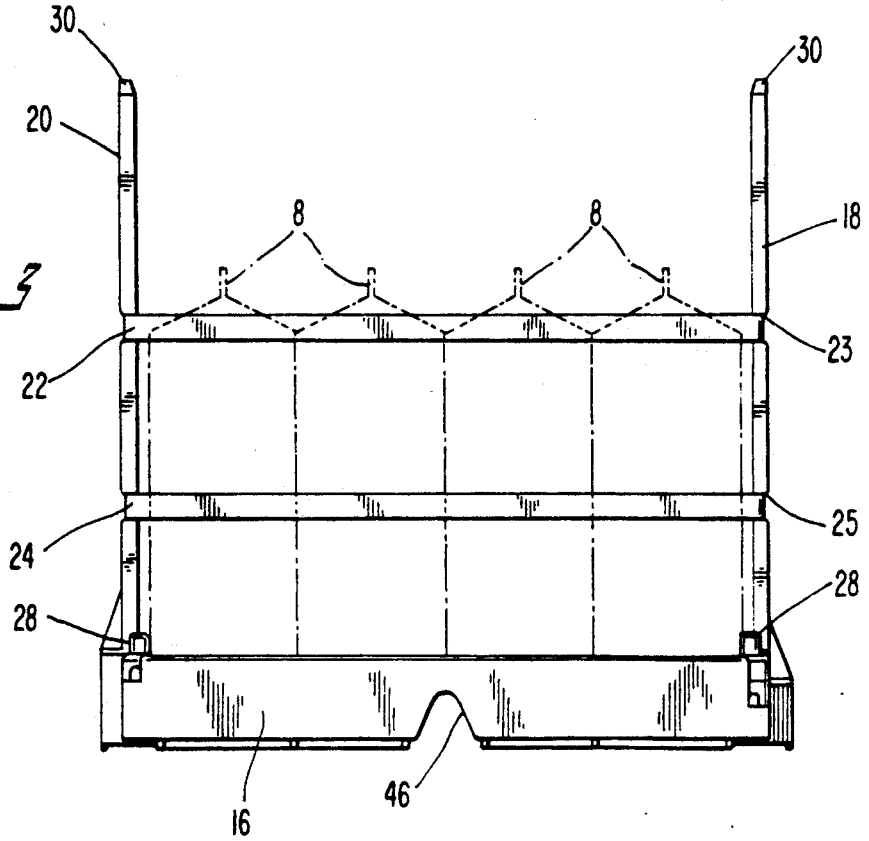
FIG. 3 is an end elevational view of the crate of FIG. 2.
Figure 4:
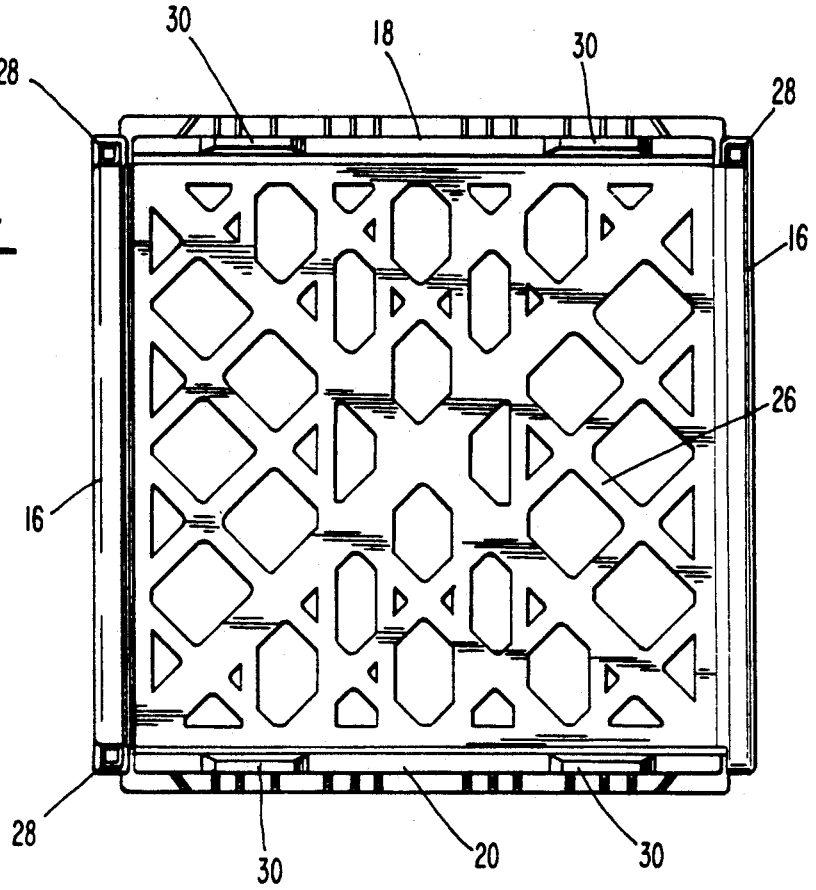
FIG. 4 is a top plan view of the crate of FIG. 2.

The upward movement of the slides 54 raises the crate to the level of the bander 14 which operates to extend a flexible band or tape through a track 66 around the crate and then to tighten the band so that it is drawn from the track into the upper groove 23 or both grooves 23 and 25 of the side wall of the crate, as shown in FIGS. 2 and 3. The bander 14 can be operated to apply either a single band 22 or two bands 22 and 24, depending upon the size of the cartons in the crate. For large cartons, such as quart size or larger, it has been found that only a single band 22 is required. To apply a single band 22, the actuators 56 and 58 extend sufficiently to raise the crate to a level where the track 66 is aligned with the upper groove 23 (FIG. 2) in the side walls 18 and 20. The bander is then operated to apply a band 22 around the crate and within the groove 23. To apply two bands, the actuators 56 and 58 are operated to align the groove 25 in the crate for the lower band 22 with the track 66 of the bander. The bander is then operated to apply the lower band 22. Pressure is then relieved in the smaller actuator 58 to allow the lever 64 to swing downwardly a sufficient distance to align the track 66 with the groove 23 for the upper band 22. By this arrangement, the bander can selectively apply either one or two bands around the crate.

Referring to FIGS. 18–20, it can be seen that the track 66 is designed to open to allow the crates to be conveyed horizontally out of the stacker unit on the conveyor 12. The track has side channel members 68 and 70 which are fixed to the frame of the unit 4 and extend outwardly from the bander 14. On the back side of the track 66, which is opposite the operating mechanism of the bander 14, a pair of pivoted track segments 72 and 74 are mounted on hinges 76. The segments 72 and 74 swing from a closed position in which the segments 72 and 74 are in alignment (FIG. 18) to a position in which the segments are spaced apart sufficiently to allow a crate to pass between the segments, as shown in dotted lines in FIG. 20.

Swinging of the segments 72 and 74 is accomplished by levers 78 which are connected with the segments 72 and 74 by links 80. As shown in FIG. 20, the track segment 72 has an extension guide 84 which fits into the channel in the other track segment 74. The guide 84 guides the band across the gap between the ends of the segments 72 and 74. The extension guide 84 swings freely clear of the track segment 74 as the track segments swing toward the open position, as shown in FIG. 20.

In the operation of the bander 14, the filled crate is positioned within the central opening in the track 66. The bander operating mechanism includes a drive wheel for advancing the band around the track 66 in a clockwise direction as viewed in FIG. 13. The band is guided to turn each corner and to pass in sequence through the side channel member 68, through the segment 72, through the guide 84, through the segment 74 and then through the side channel member 70, from which it returns to the operating mechanism. The drive wheel stops when the band has found a loop around the track 66. The bander operating mechanism then applies tension to the band while holding the opposite end fixed. The track 66 has retainer brackets 86 which are biased to close the inside of the track 66 by springs. When tension is applied to the band by the bander operating mechanism, the band applies a force against the retainer brackets 86 to overcome the force of the springs which releases the band. The band loop then tightens around the crate at the desired location. In this manner, the bander 14 applies the band 22 in the groove 23, or the band 24 in the groove 25 (FIGS. 2 and 3).

Figure 21:
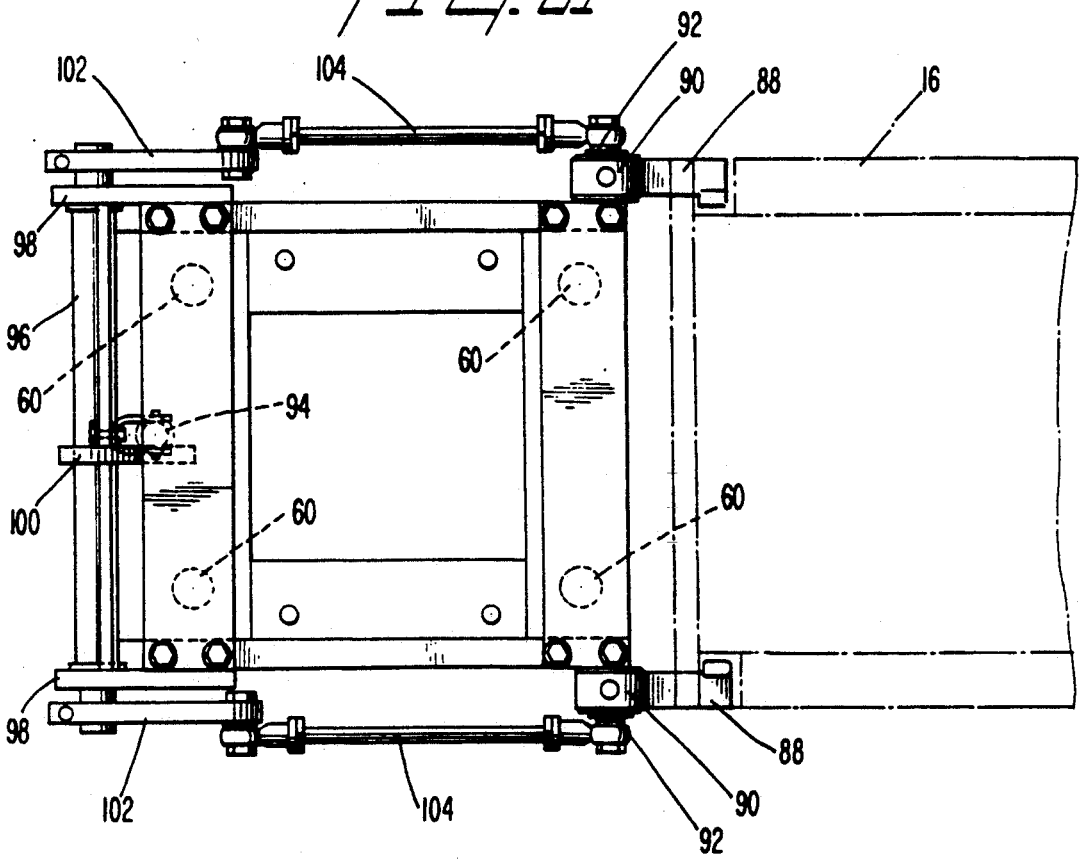
FIG. 21 is a top plan view of the crate support mechanism.
Figure 22:
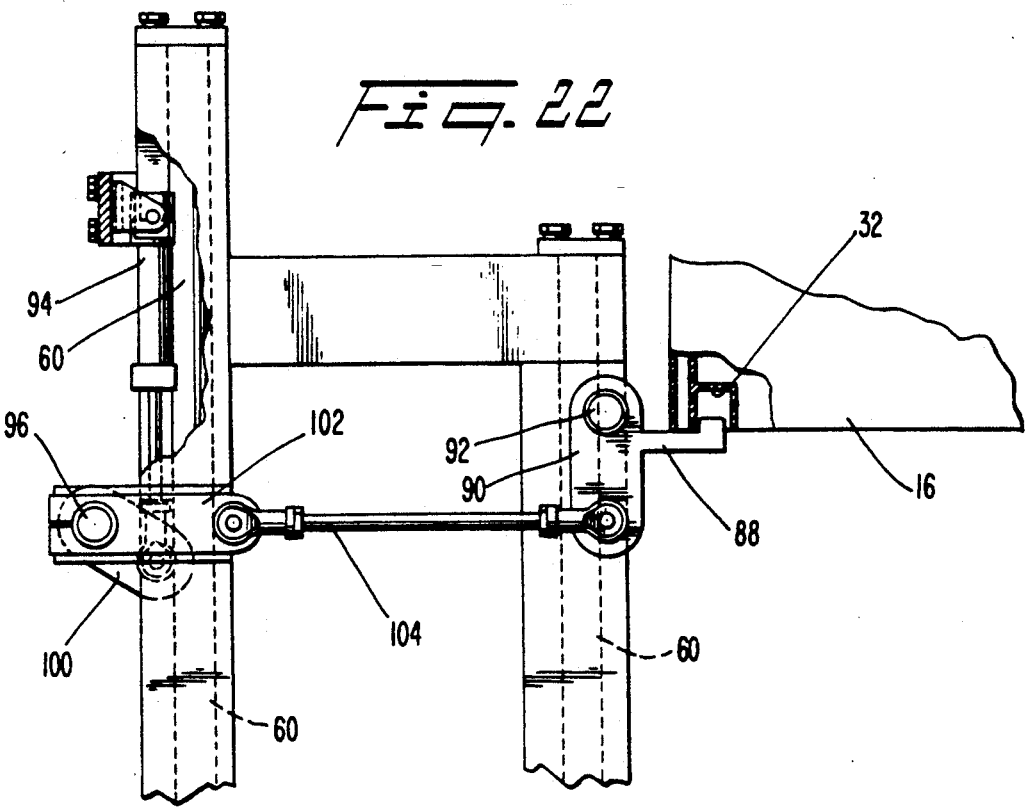
FIG. 22 is a side elevational view of the crate support mechanism.

After the band or bands have been applied, support of the crate is transferred from the slides 54 to corner supports 88. As shown in FIGS. 17, 21 and 22, these corner supports each fit into the socket 32 which is formed in each corner of the crate base 16. The supports 88 are mounted on pivoted levers 90, which swing about a journal bearing 92. A pneumatic actuator 94 is connected with a cross-shaft 96. The cross-shaft is mounted on a pair of bearing blocks 98 which are fixed to the frame of the machine. The reciprocating piston rod of the pneumatic actuator 94 is connected to the cross-shaft 96 by a crank 100. When the piston rod of the actuator 94 is retracted from the position shown in FIG. 22, a crank 102 fixed on the shaft 96 rotates upwardly. The crank 102 is connected with the lever 90 by a rod 104, which causes the lever 90 to swing in a clockwise direction and to swing the support 88 downwardly to the position shown in phantom lines in FIG. 17.

Figure 24:
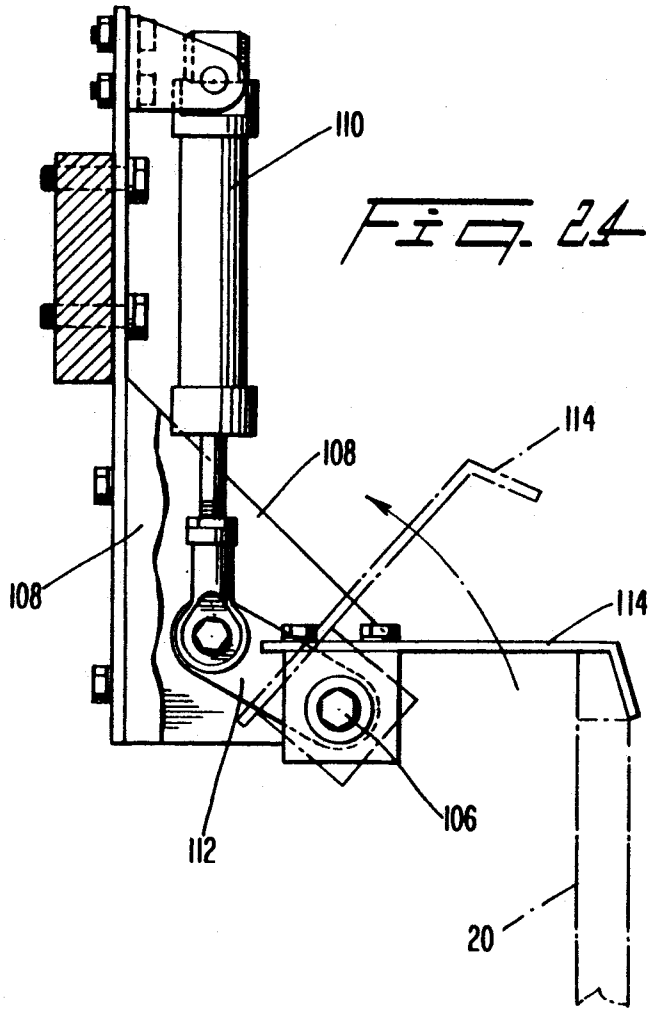
FIG. 24 is a side elevational view of the crate side holder.
Figure 23:
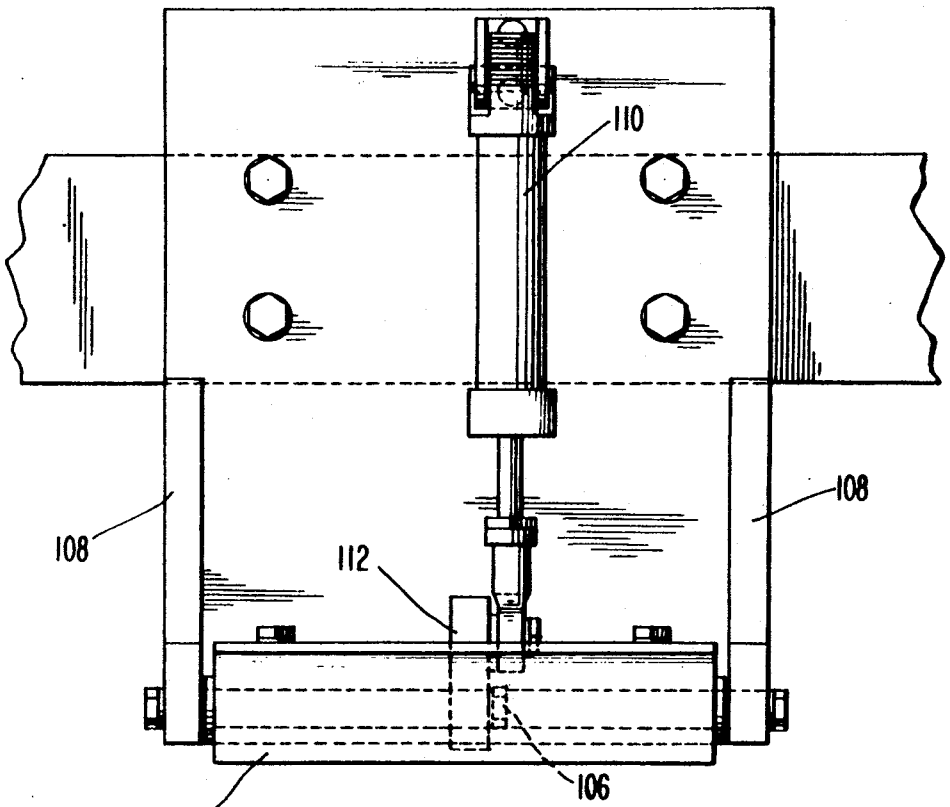
FIG. 23 is a top plan view of the crate side wall holder in a raised position.
Figure 25:
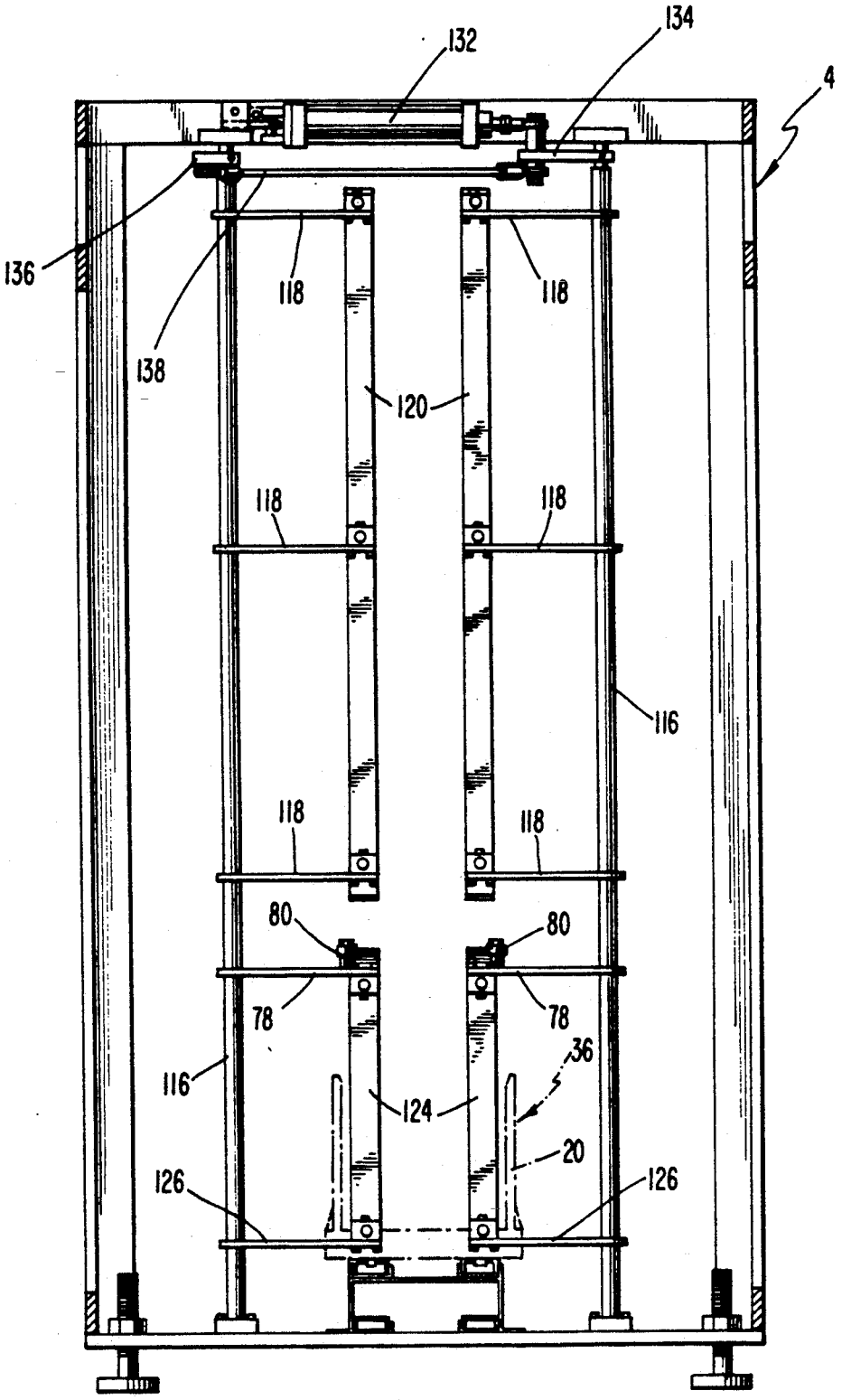
FIG. 25 is an end elevational view of the door assembly of the bander and stacker station.

As shown in FIGS. 11, 23 and 24, a mechanism 105 is provided on each side of the unit 4 to hold both side walls of the crate in an upright position when the first crate is raised to the level of the track 66. Each holder mechanism 105 is mounted on the frame of the machine and includes a transverse shaft 106 which is supported between brackets 108. A pneumatic actuator 110 is mounted between the brackets 108 and the piston rod of the actuator is connected with the shaft 106 by a crank 112. A gripping plate 114 is fixed to the shaft 106 so that it swings with the shaft from the position shown in full lines to the position shown in dotted lines in FIG. 24. When the piston of the actuator is retracted, as shown in full lines in FIG. 24, the gripping plate 114 is in position to overlap the side wall 20 of a filled crate to resist any tendency of the side wall 20 to swing toward the center of the crate during the banding operation. Upon actuation of the actuator 110, the gripping plate 114 swings upwardly out of the way so that the crate can pass upwardly in the unit 4, as additional crates are stacked on top of each other.

The unit 4 also includes a pair of gates which serve the dual purpose of aligning the crates in the stack and allowing discharge of the stack of crates from the unit 4. As shown in FIGS. 13, and 24–27, the gate mechanism includes a pair of vertical shafts 116 which are journaled at their upper and lower ends for rotation about the vertical axis. Brackets 118 are fixed to the respective shafts 116 at spaced intervals. Upper guide strips 120 are mounted on rods 122 which are received in clamps on the respective brackets 118 so that the position of the guide strips 120 can be adjusted. A pair of lower guide strips 124 are spaced downwardly from the upper guide strips 120, so as not to interfere with the track 66 (FIG. 19). As previously described, the hinged track segments 72 and 74 are connected with levers 78 by links 80. The levers 78 are fixed to the vertical shafts 116 in the same manner as the brackets 118. At the lower end of the guide strips 124, an additional bracket 126 is provided.

A pneumatic actuator 132 (FIG. 27) is provided for opening and closing the door mechanism. The piston rod of the actuator is connected to a crank 134 which is secured at the opposite end to the vertical shaft 116 at the left-hand side of the unit 4, as viewed in FIG. 27. A crank 136 is secured to the other vertical shaft 116 and the crank 136 is connected with the crank 134 by a connecting rod 138. When the piston rod of the actuator 132 is extended, the crank 134 swings counterclockwise, as viewed in FIG. 27, and this motion is transmitted to the crank 136 through the connecting rod 138 to cause the crank 136 to swing in a clockwise direction. In this manner, both of the upper and lower guide strips 120 and 124 move in a direction toward the outside of the frame of the unit 4 to allow the stack of crates to be conveyed outwardly from the unit 4 on the conveyor 12.

In operation, a filled crate is supplied to the bander and stacker unit 4 on the conveyor 12. The stop pin mechanism 38 holds the crate on the conveyor until the previous crate has been raised and banded. When released by the stop pin mechanism, the conveyor 12 moves the crate between the horizontal slides 54 until it engages the lower guide strips 126 of the door assembly. The horizontal slides 54 are extended by actuators 55 until the knobs 59 engage under the opposite sides of the base 16 of the crate. Upon extension of the actuators 56 and 58, the crate is lifted by the slides 54 to the level where the track 66 of the bander 14 is aligned with a corresponding groove in the side walls 18 and 20 of the crate (FIG. 2).

If only a single band is to be applied, the band 22 is applied in the upper groove. If two bands are to be applied, then the short actuator 58 is operated to raise the crate the additional distance necessary to align the track 66 with the groove for receiving the lower band 24 (FIG. 2). When the first crate is being banded in this manner, the side wall holders 114 (FIG. 24) are positioned in engagement with the top of the respective side walls as shown in FIGS. 11 and 22, to hold the side walls at the desired position while the bands are applied. Before the next crate moves into position at the center of the unit 4, the actuators 56 and 58 are operated so that the lever 64 moves downwardly to return the horizontal slides 54 to their original position below the level of the conveyor 12. In order to hold the crate at the desired position, the crate support mechanism is operated to swing the supports into engagement with each corner of the crate base 16. These supports hold the crate fixed at this position.

When the next crate moves into the center of the frame of the unit 4, the horizontal slides 54 again move upwardly to engage the bottom of the crate and to lift the crate vertically until it engages the sockets in the bottom of the base, as shown in FIG. 5. The lugs 30 at the top of each side wall are received in the respective sockets 32 (FIG. 6), so that the lower crate supports the weight of the upper crate. Further upward movement of the horizontal slides brings the lower crate into alignment with the track 66 of the bander 14 and the banding operation is repeated for the lower crate. This sequence is repeated until the crates are stacked to the desired height, as shown for example in FIGS. 10 and 11. The last crate is banded and then, instead of supplying another crate to the center of the frame of the unit 4, the corner support brackets 88 are lowered so that the entire stack is supported by the slides 59, so that when the slides are lowered to their original position, the entire stack is lowered onto the conveyor 12.

The door mechanism is then operated to open the doors at the rear side of the machine to allow the stack of crates to be conveyed out of the unit 4. When the door guide strips swing or are in an open position, the track segments 72 and 74 also swing outwardly (FIGS. 19, 20). Thus, the filled crates may be handled subsequently in a stack rather than individually.

While this invention has been illustrated and described in accordance with a preferred embodiment, it is recognized that variations and changes may be made therein without departing from the invention as set forth in the claims.

What is claimed is:

1. Apparatus for banding filled crates, comprising:

banding means for applying a band around a filled crate, said banding means including track means arranged in a horizontal loop for guiding a band around a filled crate, said track means including segments movable between opened and closed positions, said banding means including means for applying tension to draw the band tightly around the crate and to seal the band;

means for positioning a filled crate within said track means when said segments are in the closed position; and means for subsequently moving said segments to the opened position and moving a banded crate between said opened segments, whereby a banded crate may be removed from the apparatus.

2. The apparatus according to claim 1 wherein said means for positioning includes a pair of opposed slides in position to engage under the filled crate, said slides being movably vertically to lift the crate into the interior of said loop of said track means when said segments are in a closed position.

3. The apparatus according to claim 2 including conveyor means extending between said slides, said conveyor means extending in a direction for moving a banded crate between said track segments when said segments are in the opened position.

4. Apparatus for banding filled crates, comprising:

banding means for applying a band around a filled crate, said banding means including means for applying tension to draw the band tightly around the crate and to seal the band, said banding means including a track;

said track having a pair of opposite side channel members and a pair of track segments, the track segments being hingedly mounted for swinging relative to the side channel members between a closed position wherein the track segments are in alignment with each other and an open position wherein the track segments are spaced apart from each other;

means for supporting a filled crated in positioned to receive the band applied by said banding means; and means for subsequently moving a banded crate between said track segments when in an open position, whereby a banded crate may be removed from the apparatus.

5. The apparatus according to claim 4, wherein one of the track segments has an extension guide means which engages the other track segment when the track segments are in said closed position.

6. The apparatus according to claim 4, wherein said means for supporting a filled crate includes a pair of retractable sides in position to engage under the filled crate, said slides being movable vertically to lift the crate into a position where it is surrounded by the track when the track segments are in a closed position.

7. The apparatus according to claim 4, wherein said side channel members and said track segments are located in a substantially horizontal plane, and the track segments are each mounted for swinging about substantially vertical axes.

8. A method for applying a band around a crate comprising:

positioning a crate at a first location, the crate having a base and opposite side walls;

lifting the crate to a second location spaced above the first location;

providing a band applying unit at the second location, said unit including a horizontal track having a central opening, guiding the crate through the central opening during said lifting step;

applying a band around the crate by means of the banding unit, said track including a movable portion to allow a crate to pass horizontally through the track; and subsequently displacing the crate horizontally from the second location through the track.

9. The method according to claim 8 including lifting the crate to a third location above the second location after applying the band.

10. The method according to claim 9 including lowering the crate to said second location before said displacing step.

11. The method according to claim 10 wherein said positioning step includes advancing a crate on a conveyor and said displacing step includes displacing the crates on a conveyor, and the positioning step occurring concurrently with the displacing step.

* * * * *